United States Patent [19]

Rose et al.

[11] 4,034,828

[45] July 12, 1977

[54] SHOCK ABSORBING CABLE CONNECTOR

[75] Inventors: Clarence W. Rose, Denver; Fredies M. Elmore, Thornton, both of Colo.

[73] Assignee: Rose Manufacturing Company, Englewood, Colo.

[21] Appl. No.: 567,812

[22] Filed: Apr. 14, 1975

[51] Int. Cl.[2] ..... A62B 1/14; B65H 59/16

[52] U.S. Cl. ..... 182/5; 188/65.2; 24/134 KC

[58] Field of Search ..... 182/5, 6, 7, 10, 11, 182/192, 193, 133–136; 188/65.2, 65.1, 65.3, 65.4; 24/134 R

[56] References Cited

U.S. PATENT DOCUMENTS

| | | | |
|---|---|---|---|
| 1,300,752 | 4/1919 | Mattern | 182/5 |
| 3,179,994 | 4/1965 | Meyer | 182/3 |
| 3,797,608 | 3/1974 | Virdis | 182/112 |
| 3,852,943 | 12/1974 | Healey | 182/5 |
| 3,908,791 | 9/1975 | Kleine | 182/8 |

*Primary Examiner*—Reinaldo P. Machado
*Attorney, Agent, or Firm*—Van Valkenburgh and Lowe

[57] ABSTRACT

The invention is a two component, shock-absorbing cable connector to secure a workman to a vertically-suspended safety cable; the first component, a U-shaped shoe, is placed upon the cable with the cable at the crotch of the shoe; the second component, a head combining a slide bar, cams and a handle, is fitted and latched between the sides of the shoe with the slide bar bearing against the cable; the cams include a face engaging the slide bar and outward arms connecting with the handle; these cams operate in unison to press the slide bar against the cable responsive to downward movement of the handle; the handle is attached by a lanyard or other connector to a safety belt or harness worn by the workman; thus, a fall of the workman will be checked by the connector as the weight of the workman pulls the handle downwardly to shift the cams, forcing the slide bar against the cable and squeezing the cable between the shoe crotch and the slide bar.

11 Claims, 11 Drawing Figures

SHOCK ABSORBING CABLE CONNECTOR

The present invention relates to cable connectors, and more particularly to cable connectors for attaching a workman to a suspended cable.

One common solution to the problem of protecting an individual on a scaffold or at any other precarious high position, such as upon a ladder, resides in suspending a vertical cable alongside the workman and connecting the workman to the cable. This is done by attaching a connector to the cable and securing a safety belt or harness worn by the workman to the connector, or to a lanyard, which, in turn is attached to the connector. A successful system is the "Cable Connector for Safety Belts", U.S. Pat. No. 2,914,139, issued Nov. 24, 1959, to Clarence W. Rose, co-inventor herein. This unit is a hinged clamp formed by a pair of spreadapart springs, with the hinge being at the point of connection with a suspended cable. The hinge leaves are pulled together by the grip of a lanyard at the ends of the springs and the springs, gripping the cable, function as an effective shock absorbing connector. One objection to this unit is the excessive pressure at the hinge point gripping the cable. However, and more important, is the fact that this unit is not easy to adjust on the cable. It is a two-hand operation and often, at such a high place, a workman can have only one hand free.

Other connectors for this purpose have also been devised, yet none have really solved the problems encountered. Some types cannot be attached to or removed from the cable without the necessity of threading the end of the cable through the connector. This is not practical when the suspended cable is several hundred feet long. Hinging and clamping arrangements have been proposed as a solution to this problem, yet none of them have been found to be entirely satisfactory.

Another problem resides in the manner in which the connector grips the cable. The gripping mechanism of most connectors includes a cam-lever arrangement where a cammed surface, sometimes called a 'dog' is forced against the cable whenever the connector is subject to pressure as in checking the fall of a wearer. In many such units, the cam surface, the dog, is serrated to enhance the gripping action. The use of dogs has proven to be unsatisfactory for several reasons. In the first place, the dogs are usually arranged to grip these suspended cables so tightly as to instantly stop all movement. The result is that the sudden stop can injure the wearer of the connector. Also, in safety tests required in certain states where a weight simulating an individual was dropped a short distance to simulate a fall, the suspended cable, a ¾ inch manila rope, was actually broken because of the sudden shock upon it.

Another disadvantage found in most of such conventional devices is that they cannot be moved freely up or down the cable without the necessity of the workman either pushing or pulling horizontally with his body, or holding the device open with a hand grip. In the latter instance, in the event of a fall, the workman might not release his grip which could be disastrous to him.

With the foregoing and other considerations in view, the present invention was conceived and developed to provide a simple, rugged and reliable unit which incorporates into its structure a combination of features determined to be desirable by the use and experience of, and the shortcomings of, units presently available.

The invention comprises, in essence, a U-shaped shoe which is adapted to embrace a suspended cable with the cable lying in the crotch of the shoe and a slide bar which is carried upon a cammed head inset between the sides of the shoe. The head includes a pair of cams bearing against the slide bar to shift in unison to move the slide bar against the cable. A handle is connected with levers outstanding from the cams in a parallelogram-like arrangement and is pulled downwardly to forcibly engage the cams against the slide bar. A spring or springs between the head and acting upon the cams will normally move the cams to a cable-holding position, but permit the weight of the assembly to shift to a cable-releasing position whenever the assembly is supported by the handle. The unit will thereafter grip the cable instantly in the absence of such support, as in the event of a fall, all as hereinafter more fully set forth.

The primary object of the invention is to provide a novel and improved cable connector which funtions as a safety holding device, and as such, connects a workman to a vertically suspended cable as when he is upon a scaffold or other high location and which may be freely slidable upon the cable whenever adjustments are to be made, but which is also slidable against frictional resistance to come to a gradually decelerated stop to grip and hold to the cable without causing the shock of a sudden stop. As such, the invention is called "a shock absorbing cable connector", or simply, a "cable connector."

It follows that another object of the invention is to provide a novel and improved shock absorbing cable connector for a suspended safety cable which is connected to a lanyard fastened to a workman's safety belt, and which may be easily shifted or slid along the cable to a selected position and thereafter, grip the cable to function, in combination with the cable, the lanyard and the safety belt, as a shock absorbing safety apparatus to check, and decelerate to a stop, an accidental fall by a workman wearing the apparatus.

Another object of the invention is to provide a novel and improved cable connector which may be held by a workman in one hand and easily slid along the reach of a suspended cable, either up or down the cable, to any selected location on the cable, and which will grip the cable the instant it is released, or even instantly grip the cable in the event a workman falls while he is adjusting the connector.

Another object of the invention is to provide a novel and improved cable connector which may be used with a suspended cable as a ladder climber's safety device, which is capable of easily and freely sliding up or down the cable whenever the workman wearing the connector is climbing up or down the ladder in a normal manner, which does not require the workman to pay any attention to the connector when it is being used, and which is capable of gripping the cable whenever the workman wearing the device falls to promptly check the fall.

Another object of the invention is to provide a novel and improved shock absorbing cable connector for a suspended cable which may be quickly and easily fastened onto, or removed from, the cable at any location along the reach of the cable and which, once fastened onto the cable, automatically locks in place to prevent an accidental disengagement from the cable.

Another object of the invention is to provide a novel and improved shock absorbing cable connector for connecting a workman to a vertically suspended safety cable to check a fall from a scaffold or other high location and which includes further, a simple, failsafe arrangement for permitting a workman suspended on the cable by the connector to release the connector sufficiently so that he may slide down the cable at a comparatively slow, regulated speed.

Other objects of the invention are to provide a novel and improved shock absorbing cable connector which is a simple, economical, reliable, neat-appearing, rugged and durable apparatus.

With the foregoing and other objects in view, our present invention comprises certain constructions, combinations and arrangements of parts and elements as hereinafter described, defined in the appended claims, and illustrated in preferred embodiment by the accompanying drawings in which:

Figure 1:
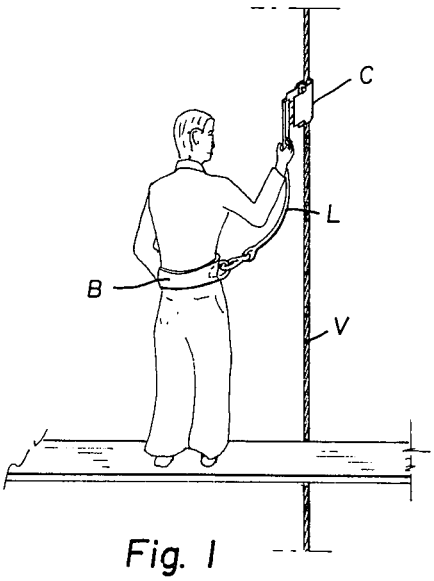
FIG. 1 is a small scale perspective view of a workman upon a scaffold with a safety cable suspended alongside the scaffold, with the workman wearing a safety belt wherefrom a lanyard extends, and with an improved shock-absorbing cable connector connecting the lanyard to the suspended cable, the connector being viewed from its right-hand side.
Figure 2:
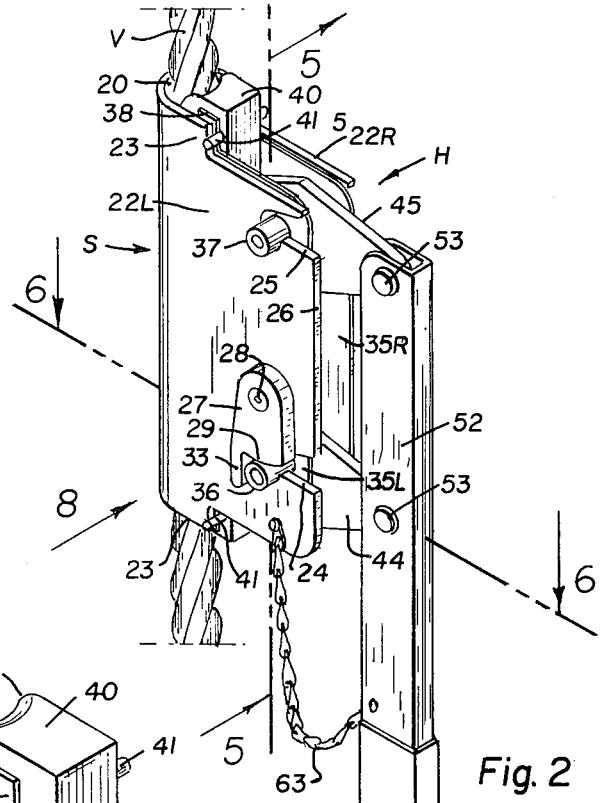
FIG. 2 is an isometric left-hand view of the cable connector secured to a vertically suspended cable.

Referring more particularly to the drawing, the improved shock-absorbing cable connector C is formed as a two-piece unit, separable for easy attachment to and removal from a vertically suspended cable V. The primary connector components mesh together and include a shoe S and a head H. The shoe S, the outer component, is formed as an elongated, U-shaped member. A cable will fit within the crotch of this shoe and the head H is then fitted into the shoe, between the sides thereof to bear against the cable. The head includes a handle which extends downwardly parallel to the cable V and is attached to a lanyard L which, in turn, connects to a safety belt B worn by a workman. This overall arrangement, of connecting a workman with a lanyard and safety belt, as shown in FIG. 1, may be varied in different ways as hereinafter explained.

Figure 3:
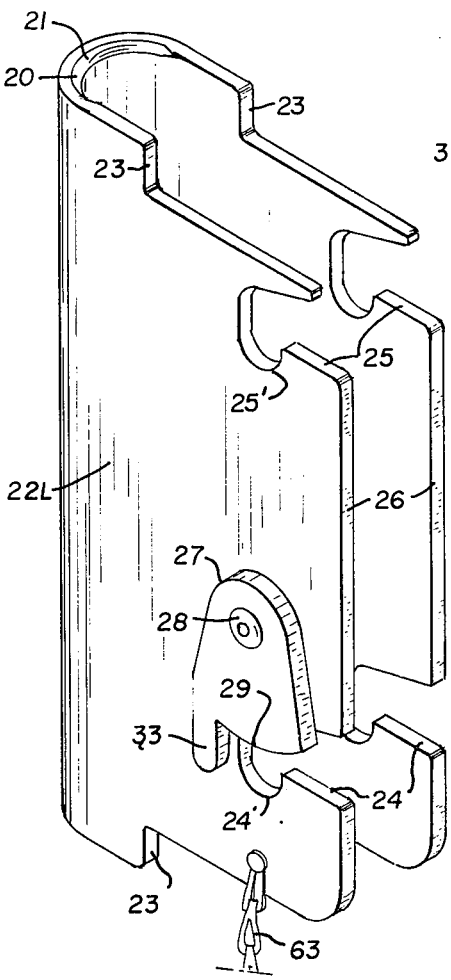
FIG. 3 is an isometric view of the shoe portion of the cable connector, the view being similar to the showing at FIG. 2 but on an enlarged scale.

The shoe S may be formed of a folded rectangular plate or it may be an extruded member of a light-weight metal such as aluminum. The crotch 20 of the U-shaped fold is hereinafter referred to as being upright when in its normal position upon the suspended cable V. The crotch 20 has an internal radius sufficient to easily accommodate a cable V for which the unit is designed and each inside end of this crotch is suitably chamfered, as at 21 in FIG. 3, to eliminate sharp edges and to provide for smoother sliding movements of the cable through the unit, especially when the cable is under pressure. The inside face of this crotch will be subject to wear, especially if the unit is to be repeatedly used for sliding down a cable. Thus, if necessary, it may be provided with a liner, or it may be hard-faced in any suitable conventional manner.

Rectangular side walls 22R and 22L of the shoe extend from each side of the crotch 20 and preferably, these walls diverge slightly from a mutual parallel spacing to more easily receive the head H between them, as hereinafter described. The side walls 22R and 22L are essentially identical in form and each side wall is inset at its top and its bottom a short distance from the crotch 20 to form necks 23 near the crotch to assist in holding the head in place. The head includes two cam axle assemblies which outstand from each side of the head, as will be hereinafter described, and which fit into bayonet slots 24 and 25 in each side wall. The slots commence from the outer, upright edge 26 of each wall with a slot 24 being near the bottom of each wall and a slot 25 being near the top of each wall. Offsets 24′ and 25′ of the bayonet slots in the side walls 22R and 22L turn downward as illustrated.

The head H is locked in place when it is fitted into the shoe with the cam axle assemblies in these slot offsets 24′ and 25′. The locking is effected by a detent 27 which overlies a portion of one of the bayonet slots, preferably the lower slot 24 on the left side wall 22L at a point where the connector is ordinarily gripped by a workman when the unit is being fastened onto or removed from a cable. This detent, a small, flat, triangular plate, extends above the slot 24 to a pivot 28 which attaches it to the side wall 22L and the lower, arcuate edge 29 of this detent plate is positioned to retain the cam axle assembly on the head H when the cam axle assembly is in the bayonet-slot offset 24′ as best shown at FIG. 8.

Figure 8:
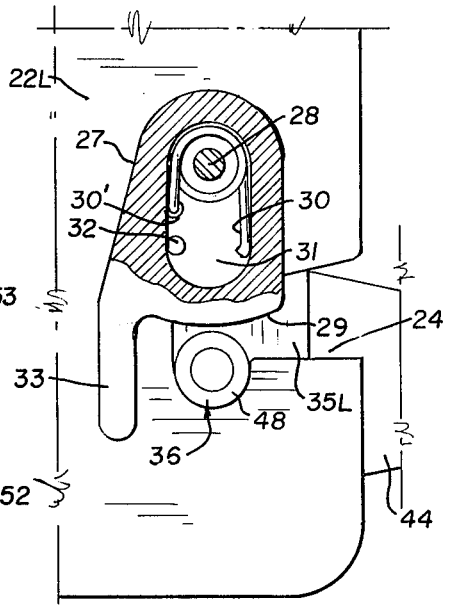
FIG. 8 is a fragmentary portion of the left-hand side of the connector illustrating a locking mechanism to lock the shoe and head together, and with portions of the mechanism broken away and in section to show constructions otherwise hidden from view.

Whenever the head H is being fitted into place in the shoe wall, this detent will freely pivot out of the way, but otherwise will snap into place by the action of a spring 30 within a recess 31 at the underside of the detent, as shown at FIG. 8. One end of the spring is fitted into a socket 30′ in the face of the side wall 22L and the other end bears against the side of the recess in the detent. The movement of the detent is limited by a small pin 32 upstanding from the side wall 22L within this recess. To complete the detent, a finger 33 depends from the edge of the detent adjacent to the shoe crotch and workman may pull this finger to shift the detent and release the head from the shoe. It may be noted that this detent is a redundant of backup safety device. When the connector is attached to the cable, the connector can be freely moved up or down and will sustain a fall of a workman without becoming detached from the cable without the detent functioning in any manner.

The head H is a flat, rectangular member with its operative components carried between two comparatively thin, rectangular retainer plates 35R and 35L which are fastened together in spaced parallelism by cam axle assemblies 36 and 37, heretofore mentioned. The retainer plates have the same general form, approximately the same height and a width somewhat less than the side walls 22R and 22L of the shoe. The retainer plates 35R and 35L are spaced apart to fit into the space between the side walls of the shoe with a moderately loose fit. Each plate 35R and 35L has upper and lower fingers 38 at the inward edges 39 of the plates which lie within the reach of the side wall necks 23 when the head is in position within the shoe. The cam axle assemblies 36 and 37 are located near the top and bottom of the retainer plates to fit into the bayonet slots 24 and 25, respectively, when the head is in position within the shoe.

A slide bar 40 having a height slightly greater than the height of the retainer plates 35R and 35L is loosely fitted between these plates to project inwardly from the inward edges 39 thereof and engage a cable V within the shoe crotch 20. This bar is approximately square in cross section and it is loosely held in position by transverse pins 41 at the top and bottom of the slide bar 40. A pin 41 may rest against the top of the retainer plates 35 or the other pin 41 may be pulled against the bottom of the retainer plates 35, the pins being adjacent to the fingers 38. The inward face of the slide bar 40 which engages the cable is formed with a longitudinally dished groove 42 to better fit against a cable within the connector. The upper end and lower end of this groove is chamfered as at 43 to avoid abusing a cable against which the face bears, especially when the unit is sliding upon the cable under pressure. Such pressure is imposed upon the slide bar 40 by cams 44 and 45 which are mounted upon the cam axle assemblies 36 and 37 as hereinafter described.

The cam axle assemblies 36 and 37 hold the retainer plates in position in spaced parallelism by tubular axles 36' and 37' spaced between the retainer plates. Each end of each axle 36' and 37' is shouldered to provide a short neck 47 and each neck snugly fits into and through a hole in a retainer plate. The necks 47 are then upset to lock together this assembly of retainer plates, axle members and cams and other components upon the axle members which are hereinafter described. A shaft 46, having a diameter the same as the internal diameter of the axles 36' and 37' and a length exceeding these axles are fitted into each axle 36' and 37' with the extended end portions of each shaft 46 projecting outwardly beyond the retainer plates. Short, tubular bushings 48 are pressed onto the extended ends of each shaft 46 to complete the cam axle assemblies 36 and 37. These assemblies project from each side of the retainer plates a distance sufficient to also project a short distance beyond each of the side walls 22R and 22L of the shoe whenever the head is within the shoe, with the axle assemblies being in their respective bayonet slots 24 and 25. The axle assembly 36, projecting beyond the shoe side wall 24R, will thus be engaged by the detent 27 as heretofore explained.

The cams 44 and 45 are pivotally mounted upon the axles 36' and 37' respectively, between the retainer plates 35R and 35L. The cams, flat, plate-like members, are normally narrower than the spacing between the retainer plates and may thus be held in place at the center of the unit by plastic spacer washers 49 and **49*a*, mounted upon the axles 36' and 37' at each side of the cams. Each cam includes an inward pressure face 50 which engages the slide bar 40 and which shifts the slide bar inwardly and against a cable V in the connector responsive to the rotation about its axle 36' or 37'. Each cam also includes an outwardly extended arm 51 which connects to a handle 52 as by a pivot pin 53. The two cams 44 and 45, one above the other, are designed to operate in unison and each is identical in form to the other. Thus, the pivotal connections to the handle 52 are spaced the same as the spacing of the axles 36' and 37'. This provides a parallelogram action between the cam arms 51, the axles 36' and 37' and the handle 52, with the handle extending downwardly, parallel to the crotch 20** of the shoe when the units are together.

Each pressure face 50 of the cams 44 and 45 is formed to move the slide bar 40 against a cable within the connector shoe whenever the cams are rotated as the handle 52 moves downwardly, relative to the shoe, or the shoe moves upwardly, relative to the handle. This rotative movement may be effected by a rapid downward movement on the handle, or by the pressure of a spring 54 on the shaft 36, as hereinafter further described. On the other hand, lifting the handle 52 to move it upwardly relative to the shoe will rotate the cams to retract the pressure face 50 of each cam from the slide bar 40 to release the connector from the cable.

Whenever the connector C is used with a lanyard attached to the handle 52 and as a safety apparatus for a workman, it is essential to provide for a shock absorbing action in the event of a fall. Should a safety apparatus bring a falling workman to a sudden stop, the workman will very likely sustain a serious injury. Thus, the cam pressure responding to a sudden downward movement of the handle 52 to check the workman's fall, must not be so great as to suddenly stop the connector. The cam pressure must be such that the connector will slide on the rope with a selected frictional resistance to gradually decelerate the workman to a stop without causing serious injury. Also, with such deceleration, there is much less chance of the force of the stop breaking the workman's safety belt, or the lanyard, or the cable, or the anchor to which the cable is connected.

With the above mentioned considerations in view, the pressure face 50 of each cam 44 and 45 is formed by varying the distance of the pressure face 50 from the axis of the respective cam axle assemblies, 36 and 37, with respect to the position of the cam arms 51. A retracted section 55 of the cam face 50 is opposite to the slide bar 40 whenever the handle 52 and the cam arms 51 are fully lifted as to the position illustrated in dotted lines at FIG. 5 where the edge of the handle 52 contacts the retainer plates 35R and 35L. At this position, the slide bar 40 may freely move away from a cable within the connector to make the connector freely slidable upon the cable. This is the position the connector will assume when it is being lifted or supported by the handle.

Figure 5:
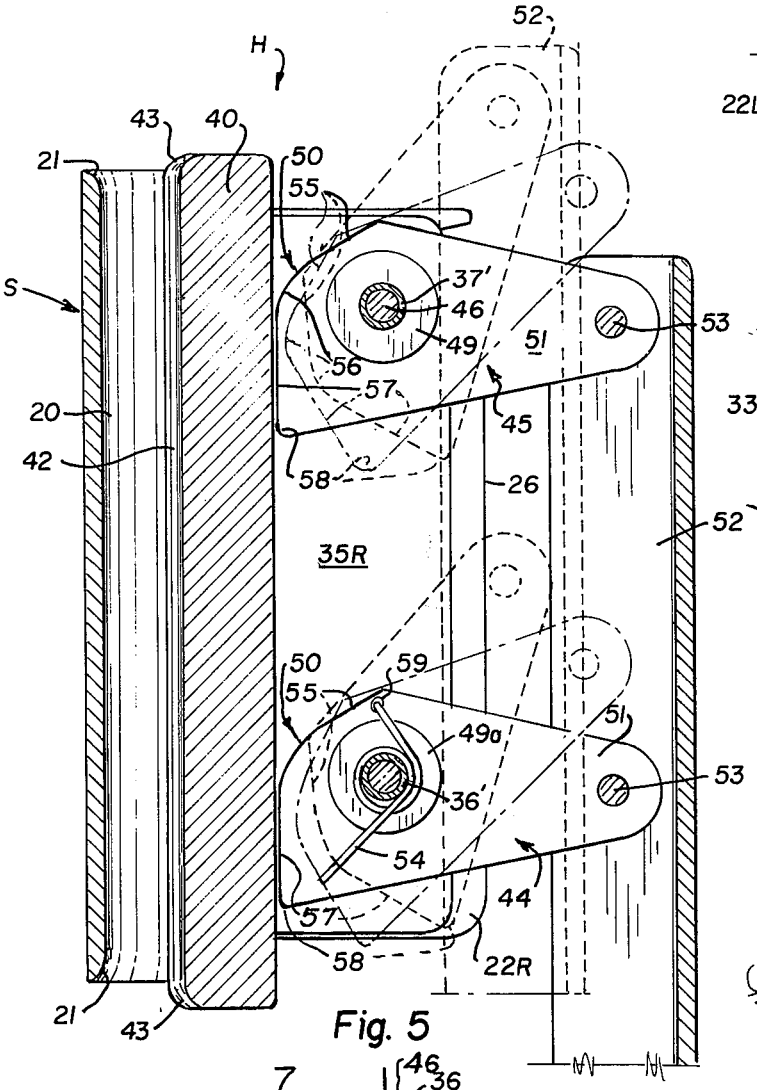
FIG. 5 is a sectional vertical elevation as taken substantially from the indicated line 5—5 at FIG. 2, but on an enlarged scale and with dotted lines and dot-dash lines showing alternate positions of camming members when the handle on the head is shifted.

As the handle is lowered with respect to the head and shoe, the cams rotate first to an intermediate position shown by the dot-dash outline of the upper cam 45 at FIG. 5, where a radius 56 of the cam face 50 begins to bear against the slide bar 40 to push it inwardly and against the cable. At this intermediate position, the slide bar grips the cable V and holds the connector in position on the cable. These radii 56 of the cams are not centered about the respective cam axles 36 and 37, but are offset to progressively increase the pressure against the slide bar 40, as the cams continue to rotate, to a point where the pressure will be sufficient to permit the connector to hold a workman regardless of his weight.

As the handle drops further, as in checking a fall, the cams rotate to the positions shown in solid lines at FIG. 5 where a flat pressure section 57 of the cam face 50 bears against the slide bar 40. At this position, the slide bar will grip the cable V with a pressure which is sufficient to increase the grip of the connector on the cable against sliding with a force exceeding the weight of a man. This is a predetermined but flexible force which will decelerate the fall velocity of a workman to a gradual stop.

This flat pressure portion 57 of the cam extends from the radius 56 to a terminl cam point 58 which is at a maximum distance from the cam axle with respect to other portions of the cam face 50. Thus, further downward movement of the handle 52 with respect to the shoe S causes this terminal point 58 to apply increased pressure against the slide bar to increase the gripping force of the connector on the cable. This action may occur whenever a workman's fall is first checked by the connector. In stopping a fall, the momentum of a falling man creates a maximum force momentarily, as an impact, as the stop commences. However, the positioning of the terminal cam point 58 can limit this impact to a force which will not be excessive, but will vary somewhat to meet extremes of need. The mechanical advantage between the arm of the cam and the distance of the cam face 50, at the terminal point 58, is reduced. Thus, the force of the impact, imposed by a weight of a falling workman forcing the handle 52 downwardly as his fall is first checked, will not be dangerously greater than the predetermined force produced by the flat pressure section 57 of the cam bearing against the slide bar 40.

This flat section 57 thus acts as a stop-limit or a limit to the magnitude of force which might be applied to the workman's body in arresting a fall. This stop limit 57 could be applied in some other manner as a positive limit on the movement of the cam as a bar or stop on the handle of the connector. Such stop would be an absolute and non-flexible limit which would not allow for mitigation in cases of length of free fall or size flexibility of the cable. The flat section of the cam 57 with its extreme limit 58 thus acts as a flexible stop-limit which can increase the stopping force moderately to accommodate for extremes of required stopping force.

By taking into account the frictional resistance between the cable and the connector through handbook information or through actual tests, the proportions of a cam face 50 and the location of this terminal point 58, with respect to the axis of the cam axle assemblies, 36 or 37, may be established in such a manner that the frictional resistance will not exceed a selected but variable amount for the weight of various individuals even though there may be minor variations in the diameter of cables or types of cables used with the connector apparatus. Moreover, it was found, through tests, that the connector, using the same cams formed as described, would work equally well in checking the fall of a heavy man or a light man.

Figure 4:
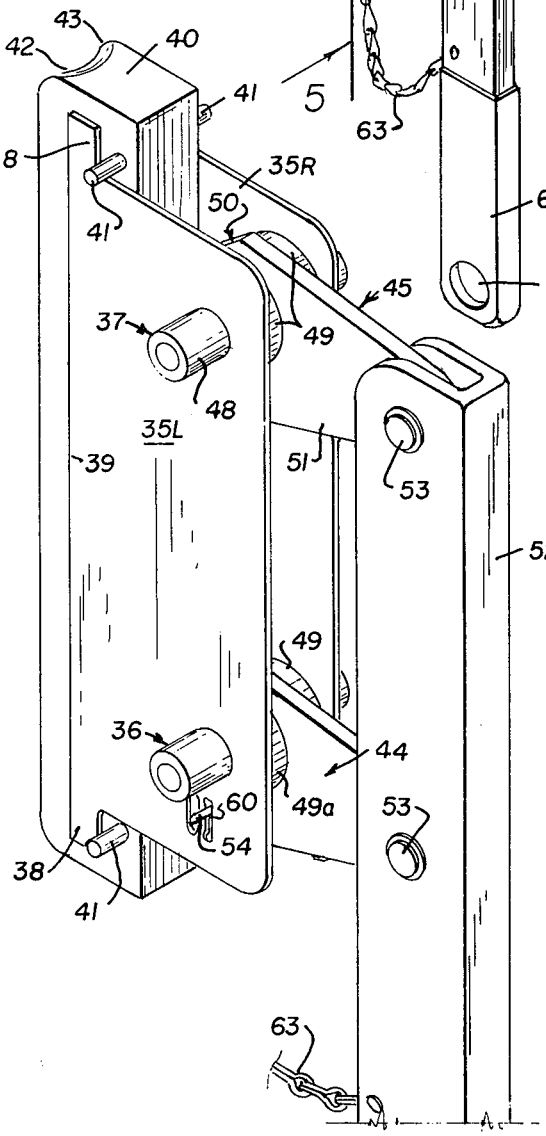
FIG. 4 is an isometric view of the head portion of the cable connector, the view being similar to the showing at FIG. 2 but on an enlarged scale.

An important feature of the invention resides in a workman being able to quickly adjust the position of the connector C upon the vertical cable V as a simple, one-hand, hand operation. This is accomplished by merely lifting the handle 52 to rotate the cams to a position where the retracted portion 55 of the pressure face is facing the slide bar and the slide bar is thus released from gripping the cable. To permit this rotating action, it is important that the cam spring 54 on axle 36 be of an intermediate strength, sufficient to cause the cams to swing to a locking position whenever the connector handle is not being supported in any manner, as at the inception of a freefall condition. Yet this spring 54 must not be so strong as to cause the cams to remain in a locked position when the workman lifts the handle to raise or lower the connector and support the weight of the shoe and slide bar by the handle. The spring 54 may be a suitable coil type mounted upon the axle 36 adjacent to the washer 48*a* which is made narrower than the washers 49 to accommodate this spring within the embrace of the side wall 35L. One end of this spring 54 is attached to the cam 44 as at 59, shown at FIG. 5, and the other end of this spring is attached to the retainer plate as at 60, as shown at FIG. 4. Thus, with this arrangement, using a spring 54 of intermediate strength, any upward push of the handle 52 causes the cams to rotate to release the grip of the connector upon a vertical cable V. However, the instant an operator lets go of the handle to permit the unit to fall free, or if the operator were himself to fall and effectively become weightless, the spring will rotate the cams to lock the connector to the cables. Although the foregoing description describes only a single spring, it is obvious that several springs, having in the aggregate a suitable intermediate strength, could be used in this apparatus and such spring or springs could even be located elsewhere on the apparatus to act in the same manner as above described.

The handle 52 is conveniently formed as a U-shaped bar with the sides thereof embracing the ends of the cam arms 51 and with pivots 53 extending therethrough as best illustrated at FIG. 4. This handle may extend downwardly from the head approximately 12 inches or any other distance which is suitable for gripping and adjusting the unit. The lower portion may be conveniently covered with a coating 61 such as polyvinyl chloride, which can be easily applied and provides for a comfortable gripping surface. The bottom of the handle may include an orifice 62 whereto a lanyard L may be attached. A small flexible chain 63 can be used to connect the handle to the shoe so that the two components of the connector C will not be accidentally completely separated.

The manner in which this connector is used in connection with attachment to a vertically suspended cable is quite apparent from the foregoing description. The connector is attached to the cable V at any location by separating the shoe S as from the head H. The shoe is then placed over the cable with the cable lying in the crotch of the shoe. The head is then snapped into place with the handle supporting the head so that the slide bar will not grip the cable until the head is seated into place. The connector, held by the handle, may be lifted to make sure the cable is not being gripped and the connector may then be shifted up or down the cable to any desired location. Thereafter, as soon as the workman lets go of the handle, or if he should fall, it will lock itself into place and function to decelerate a fall as above described.

Figure 9:
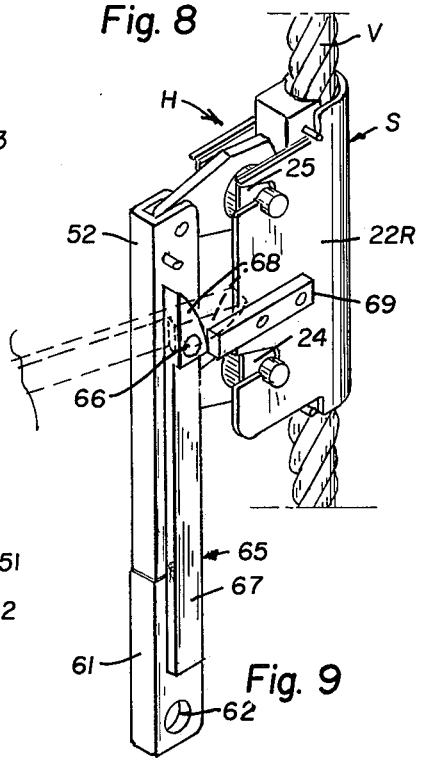
FIG. 9 is an isometric right-hand side view of the cable connector similar to FIG. 2, but on a smaller scale and illustrating an optional lowering control lever with broken lines indicating the position of the lever when it is being used.
Figure 6:
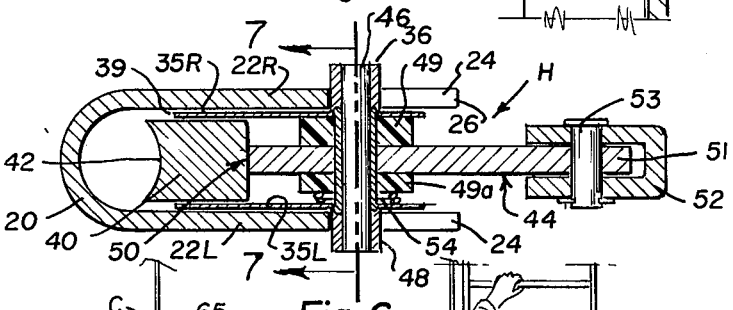
FIG. 6 is a sectional plan as taken from the indicated line 6—6 at FIG. 2 but on an enlarged scale.
Figure 7:
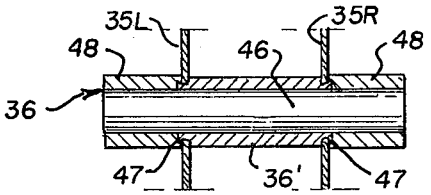
FIG. 7 is a fragmentary sectional detail as taken from the indicated line 7—7 at FIG. 6, but on a further enlarged scale.
Figure 10:
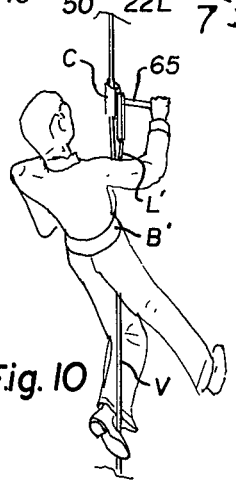
FIG. 10 is a small scale perspective view of a workman attached to a suspended cable by the safety connector and illustrating the manner in which he uses the lever shown at FIG. 9 to relieve the grip of the connector upon the cable so that he may control his descent down the cable.

FIGS. 9 and 10 illustrate a connector having a supplementary lever 65 which may be added to permit a workman to safely and easily lower himself down the cable should this become necessary or desirable. If this lowering accessory is to be used, the lanyard, as shown, must be eliminated and a more suitable type of body harness B', such as a bootswains swing, should be worn by the workman. This body harness B' will be connected to the handle 52 by a short strap attachment or lanyard L' to permit the workman to reach the lever 65 while he is being supported by the apparatus. The lever 65 is formed as a straight bar connected to the handle 52 by a pivot 66 positioned between the upper and lower cams 44 and 45. A gripping arm 67 of this lever 65 is normally below the pivot 55 and is adapted to normally lie alongside the handle 52 to extend downwardly to the gripping portion 61 of the handle 52. This arm 67 may include a suitable cutout, not shown, on the side adjacent to the handle 52 to override the lower axle pin 53 connecting the handle 52 to a cam arm. Whenever the arm is in the downward position alongside the handle 52, the handle will be used in a normal manner, to raise or lower the connector on the vertical cable and the lever 65 will not interfere with the gripping of the handle.

A curved pressure surface 68 is formed at the top of this lever 65 and will project from the handle 52 and towards a bar 69 affixed to the side wall 22R of the shoe S whenever the arm 67 is swung outwardly and lifted as shown at FIG. 10, and in broken lines at FIG. 9. This pressure surface 68 engages the bar 69 whenever the arm 67 is lifted. Thus, lifting of the arm 67 of the lever causes the handle 62 to be lifted with respect to the connector head and shoe. This, in turn, causes the cams 44 and 45 within the head of the connector to be rotated slightly from their locked positions to release some of the pressure exerted by the slide bar 40 against the cable V. The connector will then slide down the cable under the control of the workman held thereby. The operation of this lever 65, to permit the connector to slide down a cable as shown at FIG. 10, is failsafe in several ways, in that if the workman lets go of the lever, the unit will automatically come to a stop. Should the workman panic, and a normal reflex pulls his arms downwardly, the unit will also stop even though he would not let go of the lever arm 67.

Figure 11:
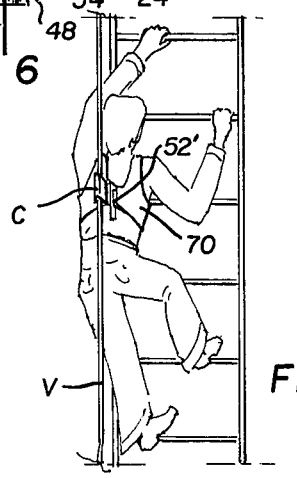
FIG. 11 is a small scale perspective view of a workman climbing a ladder with a safety connector being carried by him upon a shoulder harness and with the connector being attached to a suspended cable.

This connector is suitable for purposes other than use as a safety apparatus on a scaffold. For example, one application resides in using the connector as a safety apparatus for ladder climbing as shown at FIG. 11. The connector may be mounted upon the body of the workman at any suitable location which will not interfere with his ladder climbing activities, such as upon a shoulder harness 70. When the harness 70 is used, the connector handle 52 may be slightly modified for better attachment to this shoulder harness. A safety cable V is suspended adjacent to the ladder, but this cable is not connected to the ladder in a manner which would interfere with the worker's movements. The connector is then easily attached to the cable by a simple, snap-on operation such as previously described.

Whenever the workman is climbing a ladder, up or down, the weight of the head and shoe of the connector against its handle 52, which is attached to and supported by the workman's harness, will cause the connector to remain at an open position. So held, the spring 54 on the cam 44 will not sufficiently react against the weight of the shoe and head bearing downwardly against the handle 52 to cause gripping of the cable, and thus, the connector slides freely upon the cable and the workman may climb up and down the ladder without paying attention to the safety apparatus. However, should a workman faint, or otherwise slip and fall from the ladder, the connector will then immediately grip the cable to stop his fall. Whenever a fall commences where the workman and the connector become effectively weightless, the spring 54 can overcome the inertia of the connector and quickly move the cams to their locking positions effectively decelerating the free fall.

We have now described our invention in considerable detail. However, it is obvious that others skilled in the art can build and devise alternate and equivalent constructions which are nevertheless within the spirit and scope of our invention. Hence, we desire that out protection be limited, not by the constructions illustrated and described, but only by the proper scope of the appended claims.

What is claimed is:

1. A safety cable connector for attaching a workman to a suspended cable as by a lanyard having one end connected to the connector and the other end connected to the workman, said connector being easily moved up and down the cable when properly held by the workman, but locking into the cable when released, or when the workman falls as from a scaffold, said connector comprising:

a. a passageway through the connector, through which the cable extends, with the suspended cable therethrough holding the connector in an upright position;

b. a cam means engaging the cable within the connector, including a pivotally connected hand holding means for properly holding and adjusting the connector up or down the cable, said hand holding means moving downwardly with respect to the upright connector on the cable to shift the cam means to grip and lock the connector onto the cable and moving upwardly with respect to the connector to release the connector from the cable, whereby, whenever the workman is holding the connector at the hand holding means, the weight of the connector moves the hand holding means upwardly relative to the connector to release the grip of the connector on the cable;

c. a spring means urging said hand holding means towards the downward cable-locking position, but with the strength of the spring means being insufficient to overcome the weight of the connector whenever a workman is holding the connector at the hand holding means with the connector at the cable-releasing position, but with the strength of the spring means being sufficient to promptly move the hand holding means downwardly to the cable-locking position whenever the workman releases the connector or removes all upward force against the hand holding means as during a fall; and wherein d. said connection of the lanyard to the connector is at said hand holding means;

e. said hand holding means always being essentially parallel to said passageway.

2. A safety cable connector for attaching a workman to a suspended cable as by a lanyard having one end connected to the connector and the other end connected to the workman, said connector being easily moved up and down the cable when properly held by the workman, but immediately locking onto the cable when released, or when the workman falls as from a scaffold, said connector comprising:

a. a passageway through the connector, through which the cable extends, with the suspended cable therethrough holding the connector is an upright position;

b. a fixed slide surface in the passageway at one side of the cable;

c. a laterally shiftable slide bar within the connector with the cable extending between the slide surface and slide bar to be gripped whenever the slide bar moves toward the slide surface and against the cable;

d. a cam means engaging the slide bar within the connector to grip the same, including a pivotally connected hand holding means for properly holding the connector, said hand holding means moving downwardly with respect to the upright connector on the cable to shift the cam means against the slide bar and the slide bar against the cable to lock the connector onto the cable, said hand holding means moving upwardly with respect to the connector to shift the cam means away from the slide bar and the slide bar away from the cable to release the grip of the connector on the cable, whereby, whenever the workman is supporting the connector at the hand holding means, the weight of the connector moves the hand holding means upwardly relative to the connector to release grip of the connector on the cable;

e. a spring means urging said hand holding means towards the downward cable-locking position, but with the strength of the spring means being insufficient to overcome the weight of the connector whenever a workman is supporting the connector at the hand holding means with the connector at the cable-releasing position, but with the strength of the spring means being sufficient to promptly move the hand holding means downwardly to the cable-locking position whenever the workman releases the connector or removes all upward force against the hand holding means as during a fall;

f. said connection of the lanyard to the connector is at said hand holding means;

g. said hand holding means always being essentially parallel to said passageway.

3. In the connector defined in claim 2, wherein:

the connector is formed as two separable components to facilitate mounting and removing the same to and from the cable; and wherein one of said components comprises a U-shaped shoe having side walls extending from the crotch of the shoe and the aforesaid slide surface is at the crotch of this shoe; and the other component comprises:

a retainer plate supporting the slide bar, the cam means, a means for interconnecting the retainer plate to the shoe.

4. In the connector defined in claim 2, wherein:

the connector is formed as two separable components to facilitate mounting and removing the same to and from the cable; and wherein one of said components comprises a U-shaped shoe having side walls extending from the crotch of the shoe and the aforesaid slide surface is at the crotch of this shoe; and the other component comprises:

a retainer plate on each side of the cam means supporting the slide bar, the cam means, a means for interconnecting the retainer plates to the shoe, and means for attaching said spring means between the cam means and plates.

5. A two-piece safety cable connector which comes together about a suspended cable for attaching a workman to the cable as by a lanyard means having one end connected to the connector and the other end connected to the workman, said connector being easily moved up and down the cable when properly held by the workman, but locking onto the cable when released or when the workman falls, as from a scaffold, said connector comprising:

a. a first piece formed as a U-shaped shoe having opposing parallel sidewalls extending from a crotch, and being proportioned to receive the cable between the sidewalls to lie against the crotch with the crotch being upright when the two pieces of the connector come together about the cable;

b. a second piece constituting a head having a pair of spaced retainer plates adapted to lie between the sidewalls of the shoe when the two pieces come together;

c. means to latch the head to the shoe when the two pieces come together;

d. a slide bar shiftably carried by and between the retainer plates to lie upright adjacent to the shoe crotch with one side being against a cable within the shoe;

e. a pair of rotatable cams between the retainer plates one above the other and mounted on pivots held by the retainer plates with each cam having a selectively varying slidebar engaging face at one side of its pivot which face engages a point at the adjacent side of the slide bar to urge the slide bar against the cable with increasing pressure as the cam is rotated upwardly about its pivot to cause the connector to grip the cable, and a laterally extended cam arm at the other side of its cam pivot to extend outwardly beyond the retainer plates and rotate downwardly when the cam face rotates upwardly;

f. an upright handle, including a hand grip portion, pivotally interconnecting each cam arm to rotate both cams in unison as the handle moves upwardly and downwardly with respect to the connector, to a cable releasing position when the handle moves upwardly and to a cable-gripping position when the handle moves downwardly, whereby, with the handle being supported by a workman, the weight of the connector moves the handle upwardly with respect to the connector to the cable release position; and g. a spring means urging the handle towards the downward cable-gripping position, but with the strength of the spring means being insufficient to overcome the weight of the connector whenever a workman is supporting the connector by the handle with the connector at the cable-releasing position, but with the strength of the spring means being sufficient to promptly move the handle downwardly to the cable gripping position whenever the workman releases the connector or removes all upward force against the hand holding means as during a fall; and wherein h. said connection of the lanyard means to the connector is at the handle.

6. The connector defined in claim 5, wherein:

the slide-bar-engaging face of each cam is segmented to provide a first retracted section which opposes but does not forcibly engage the slide bar when the handle is at the upward position with respect to the connector, to permit the slide bar to release the cable;

a second, curved section which pushes the slide bar against the cable with an increasing pressure as the handle is pulled downwardly from the upward position and to an intermediate position with respect to the connector, as in a fall;

a third, flat pressure section which holds the slide bar against the cable with a selected pressure when the handle is pulled downwardly beyond the intermediate position and to a holding position with respect to the connector; and a pressure point at the end of this flat pressure section at the end opposite to the curved section, which pushes the slide bar against the cable with increasing pressure as the handle is pulled downwardly and beyond the holding position, said pressure point being at an increased distance from the pivot and thereby reducing the leverage effect of the cam arm and minimizing the increase of pressure of the slide bar against the cable responsive to an increased pull on the handle.

7. The connector defined in claim 5, wherein the means to latch the head onto the shoe comprises:

lateral extensions of the cam pivots, to outstand from each retainer plate; and bayonet slots in the shoe wall to receive the cam pivot extensions, each bayonet slot including a holding offset where the cam pivot are seated whenever the head is at its proper position between the shoe side plates.

8. The apparatus defined in claim 7, including:

a swingable detent fitted over a bayonet slot to swing to a normal position to lock a cam pivot in place in the bayonet slot offset and to a release position to permit the cam pivot extension to be removed from the bayonet slot; and a spring means to hold the detent at the aforesaid normal position.

9. The connector defined in claim 5, wherein:

the lanyard means connects with a safety harness worn by a workman and is several feet long, sufficient to permit lateral freedom of movement by the workman as upon a scaffold.

10. The connector defined in claim 5, wherein:

the lanyard means is attached to a body harness to carry the connector adjacent to the workman and has a length sufficient to permit the connector to be mounted upon a suspended cable near a ladder so the workman may support the connector by the lanyard means to permit him to climb up and down the ladder with the connector at a cable-release position but providing for an automatic, instant locking action should the workman fall from the ladder, whereupon the lanyard means pulls said handle downwardly.

11. The apparatus defined in claim 5, including:

a supplementary lever rotatably mounted upon the handle, having a longer arm and a shorter arm with the shorter arm extending to an abutment means on the shoe and the longer arm outstanding from the handle when the shorter arm is rotated to engage the abutment means, whereby a workman held by the connector can push the longer arm of the lever upwardly to forcibly lift the handle with respect to the connector body, and shoe, when the handle is being held downwardly by the weight of an individual secured thereto, whereby to release the pressure on the slide bar sufficiently to permit the workman to controllably slide down the cable.

* * * * *

UNITED STATES PATENT AND TRADEMARK OFFICE

CERTIFICATE OF CORRECTION

PATENT NO. : 4,034,828

DATED : July 12, 1977

INVENTOR(S) : Clarence W. Rose, Fredies M. Elmore

It is certified that error appears in the above-identified patent and that said Letters Patent are hereby corrected as shown below:

Column 4, line 68, insert -- a -- between "and" and "workman"; Column 5, line 2, "of" should read -- or --; Column 7, line 23, "terminl" should read -- terminal --; Column 7, line 52, -- and -- should be inserted between "size" and "flexi-"; Column 8, line 21, "48a" should read -- 49a --; Column 9, line 36, "handle 62" should read -- handle 52 --; Column 10, line 20, "out" should read -- our --; and Column 13, line 38 (Claim 7) the word -- extensions -- should have been inserted between the words "pivot" and "are".

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*